US005106426A

United States Patent [19]

König et al.

[11] Patent Number: 5,106,426

[45] Date of Patent: * Apr. 21, 1992

[54] METHOD FOR CLEANING WINDOW FURNISHINGS

[75] Inventors: Reinhard König, Mahlbergweg 5, 7505 Ettlingen; Friedrich König, Ettlingen, both of Fed. Rep. of Germany

[73] Assignee: Reinhard König, Ettlingen, Fed. Rep. of Germany

[ * ] Notice: The portion of the term of this patent subsequent to Jun. 4, 2008 has been disclaimed.

[21] Appl. No.: 661,812

[22] Filed: Feb. 27, 1991

Related U.S. Application Data

[63] Continuation-in-part of Ser. No. 386,419, Jul. 27, 1989, Pat. No. 5,021,097.

[30] Foreign Application Priority Data

Jul. 28, 1988 [DE] Fed. Rep. of Germany ..... 3825622

[51] Int. Cl.[5] ..... B08B 3/04; B08B 7/00; A47L 15/02

[52] U.S. Cl. ..... 134/25.1; 134/25.5; 134/26; 134/29; 134/31; 134/40; 134/37; 134/10; 134/129; 134/188; 15/77; 15/102; 15/103; 15/302; 15/303; 15/306.1

[58] Field of Search ..... 134/10, 26, 25.1, 25.5, 134/29, 31, 40, 37, 129, 188; 15/302, 303, 306.1, 103, 102, 77

[56] References Cited

U.S. PATENT DOCUMENTS 4,817,646 4/1989 Brooks ..... 134/29
5,021,097 6/1991 König et al. ..... 134/40

*Primary Examiner*—Theodore Morry
*Assistant Examiner*—Zeinab El-Arini
*Attorney, Agent, or Firm*—Max Fogiel

[57] ABSTRACT

A method of cleaning window furnishings while located in their place of use, in which the furnishings are pushed together to form a vertically hanging block and a wetting medium is circulated from above. A cleaning washing medium is thereafter circulated from above, followed by a rinsing liquid also from above and over the window furnishings. The furnishings are then dried, and surplus fluids are collected at a base of the furnishings. All procedures are carried out while the window furnishings are hanging vertically in their locations of normal use. The wetting medium, washing medium and the rinsing liquid flow downward due to gravity with uniform velocity and cover the furnishings uniformly.

4 Claims, 3 Drawing Sheets

METHOD FOR CLEANING WINDOW FURNISHINGS

The present application is a continuation-in-part of the parent application Ser. No. 386,419 filed July 27, 1989 now is U.S. Pat. No. 5,021.097.

The present invention relates generally to a method of cleaning window furnishings which are used in particular for decorating windows, and an apparatus for carrying out such a method.

In this specification the term 'window furnishing' is used to denote a curtain, a blind, a drape, an internal shutter arrangement and the like, and the term 'window furnishing portion' is used to denote a piece of curtain or drape, a slat of a blind or shutter arrangement, and the like.

Window furnishings which are used for example for the purposes of decorating windows become soiled in the course of time and therefore desirably have to be cleaned at certain intervals. Particularly in the case of slat-like portions of curtains, drapes, blinds and the like, the cleaning operation is found to involve a considerable amount of time and work, and also considerable inconvenience, insofar as the soiled slats or pieces of fabric have to be removed from the window, cleaned piece by piece by washing and brushing and then reinstalled.

Besides the considerable amount of work and time involved in that operation, it has also been found that, after the cleaning operation has been carried out, there may be differences in length between the window furnishing portions after they have been fitted into position again. Obviously, such variations in length can have a major adverse effect on the intended decorative character of a window furnishing of that kind. To avoid that situation arising, soiled window furnishing portions are in many cases simply replaced by new window furnishing portions, although, as will be appreciated, that is often extremely expensive.

SUMMARY OF THE INVENTION

An object of the present invention is to provide a method of cleaning window furnishings which does not suffer from the above-discussed disadvantages.

Another object of the present invention is to provide a method of cleaning window furnishings with which the window furnishings can be quickly and easily cleaned under the same physical conditions applying to the whole of the window furnishing portions involved.

Still another object of the present invention is to provide a method of cleaning window furnishings which does not involve removal of the window furnishings from the installed position, while however not giving rise to serious untidiness and mess in the cleaning operation.

Yet another object of the present invention is to provide an apparatus for cleaning window furnishings, which is quick and simple to use while providing a reliable and tidy cleaning effect.

In accordance with an aspect of the present invention these and other objects are achieved by a method of cleaning window furnishings wherein, in a first step, the window furnishing to be cleaned, while still in the position of installation thereof, is pushed together to form a block, hanging on a runner rail supporting the window furnishing, in a second step washing-action medium is circulated from above over the window furnishing in its pushed-together condition, in a third step rinsing liquid is circulated from above over the window furnishing, and in a fourth step the window furnishing is dried.

It will be seen therefore that, with that mode of operation, the window furnishing portions to be cleaned do not need to be taken down from the window for the purposes of cleaning same, and then rehung after the cleaning operation, but remain in their normal position of installation in which they are suspended from a runner rail, track or the like. It will be seen that that means that the cleaning method can be carried out quickly and inexpensively while in addition all the parts of the furnishing material to be cleaned are subjected to the same physical conditions during the cleaning procedure.

In accordance with a preferred feature of the invention the window furnishing is subjected to the drying operation in a free-hanging condition. Alternatively, the window furnishing can be dried in the pushed-together condition of constituting a block configuration, insofar as rinsing liquid which is still contained in the window furnishing drips away under the effect of the force of gravity. In that phase it has been found desirable for the window furnishing to be dried to be clamped between clamping bars and thereby held in the correct form.

In another aspect of the present invention there is provided an apparatus for cleaning window furnishing portions, comprising a washing device which can be suspended on a runner rail, track member or the like carrying the window furnishing to be cleaned. The washing device essentially comprises an abutment means for fixing a required position on the runner rail, track or the like, a nozzle assembly, a casing means extending downwardly from the nozzle assembly and in use of the apparatus enclosing the window furnishing to be cleaned in a tubular configuration, and a collecting trough at the lower end of the casing means.

In an advantageous feature of the apparatus according to the invention the abutment and the nozzle assembly may be enclosed by a frame which in turn carries the casing means enclosing the window furnishing to be cleaned.

The abutment and the nozzle assembly may also have clamping elements which permit the window furnishing which is guided in a hanging condition on the runner rail, track or the like, to be held in the condition of being pushed together for the cleaning operation.

In a preferred feature of the invention the spacing between the nozzle assembly and the collecting trough means is adjustable for the purposes of permitting adaptation of the apparatus to different lengths of the window furnishing to be cleaned. In a preferred embodiment of the apparatus, the collecting trough means into which the casing means which encloses the window furnishing to be cleaned should project may be connected by way of adjustable support means to the frame enclosing the nozzle assembly and the abutment.

In another embodiment of the apparatus according to the invention, between the collecting trough means and a pump for selectively delivering washing-action medium or rinsing liquid, at the lowest point in the circuit thereof, is an auxiliary vessel which is of larger capacity than the containers for storing and supplying the washing-action medium and the rinsing liquid respectively, wherein the auxiliary vessel can be selectively connected to respective ones of said containers so that the entire supply of washing-action medium on the one hand and the entire supply of rinsing liquid on the other hand can be selectively introduced into the auxiliary vessel in operation of the apparatus.

The apparatus may advantageously include a suitable conduit system, associated valves and a pump, to provide that washing-action medium and then rinsing liquid such as water can be successively circulated from above over the window furnishing material to be cleaned.

In normal use of the apparatus the auxiliary vessel referred to above stands on the floor and the associated storage and supply containers thereof are arranged at such a level that the content thereof can always drain off into the auxiliary vessel when the appropriate valve is in the appropriate position. For the purposes of emptying the content of the auxiliary vessel back into the respective storage and supply container, the auxiliary vessel can then be lifted to a higher level than the respective container.

Desirably, the apparatus may include a carriage or truck for carrying the operating units of the apparatus such as the above-mentioned storage and supply containers, conduits, valves, pump, possibly a heating means, and the above-mentioned auxiliary vessel. That therefore provides a mobile apparatus which is easy to handle for the cleaning operation concerned.

Further objects, features and advantages of the present invention will be apparent from the following description of a preferred embodiment of the invention.

DESCRIPTION OF THE PREFERRED EMBODIMENT

Figure 1:
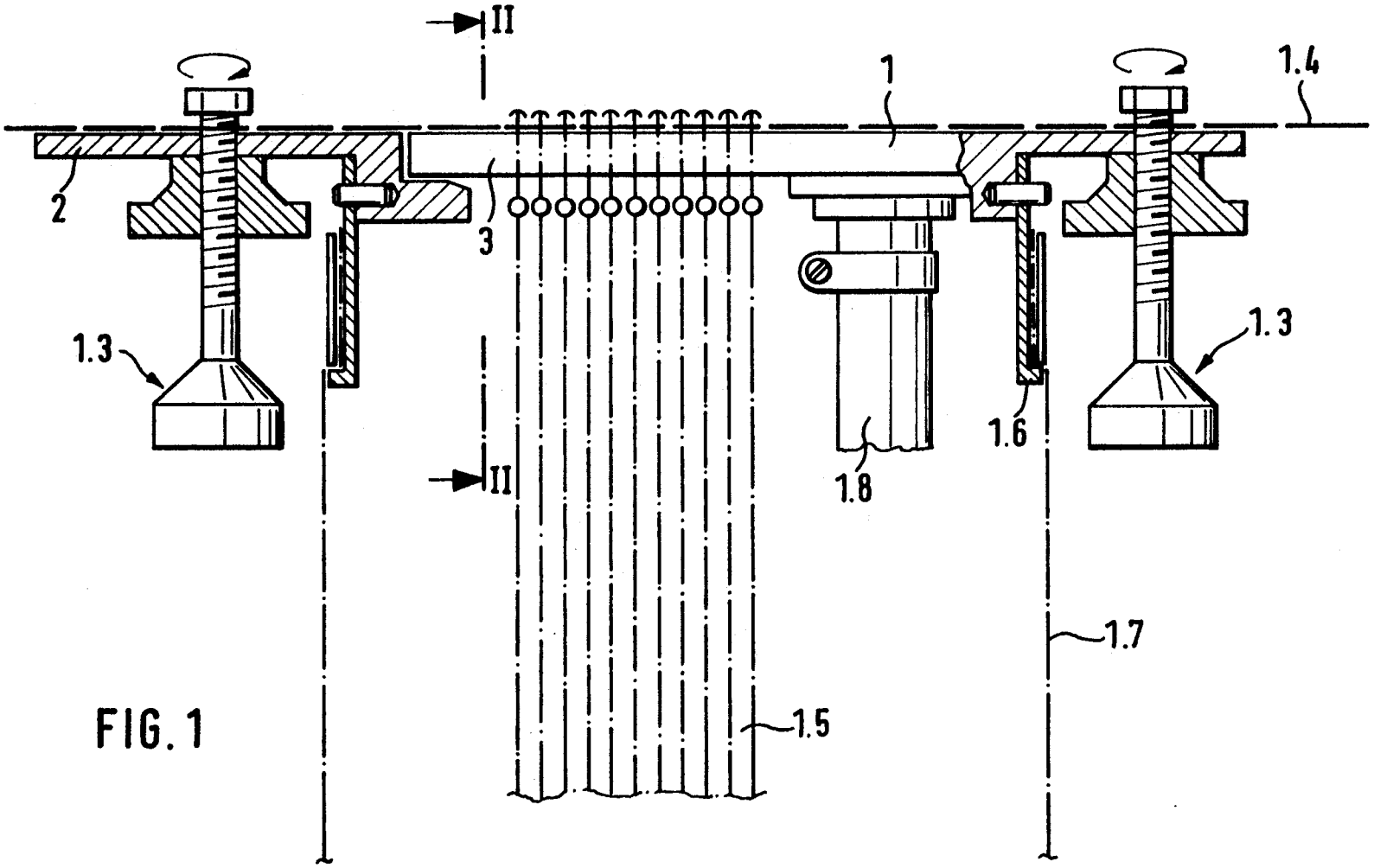
FIG. 1 is a sectional side view of part of the apparatus according to the invention, comprising the washing device which is suspended on a window furnishing runner rail, track or the like, and window furnishing portions such as slat members which are pushed together to form a block configuration.
Figure 2:
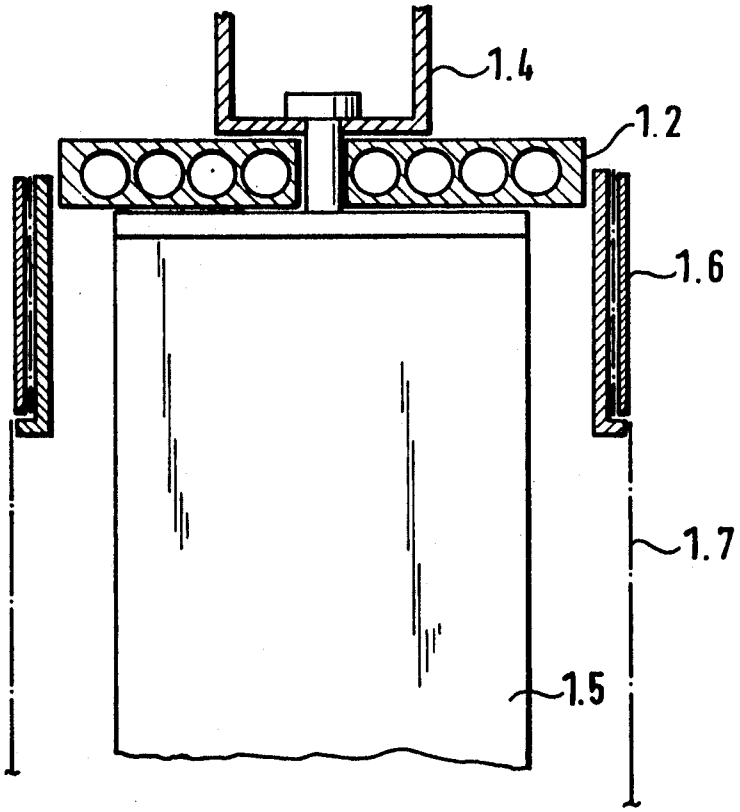
FIG. 2 is a view of the washing device in section taken along line A—A in FIG. 1.

Referring firstly to FIG. 1, shown therein is part of the washing apparatus according to the invention, comprising a washing device which is indicated generally by reference numeral 1. The washing device 1 comprises an abutment indicated at 1.1 and a nozzle assembly which is indicated more clearly at 1.2 in FIG. 2. The abutment 1.1 and the nozzle assembly 1.2 are releasably connected by means of clamping elements 1.3 in the form of screws with lock nuts thereon, to a runner rail or track member 1.4 which supports the window furnishing portions in such a way that they hang downwardly therefrom, being slidable thereon. In the view shown in FIG. 1 the window furnishing portions have been pushed together to form a block configuration indicated at 1.5.

The abutment 1.1 and the nozzle assembly 1.2 are surrounded by a frame structure 1.6 to which is fixed a casing means 1.7 which extends downwardly from the frame structure 1.6 and which encloses the block configuration 1.5, in a generally tubular configuration. Reference numeral 1.8 in FIG. 1 diagrammatically indicates a feed conduit by way of which the nozzle assembly 1.2 can be alternatively supplied with washing-action medium and with rinsing liquid.

Figure 3:
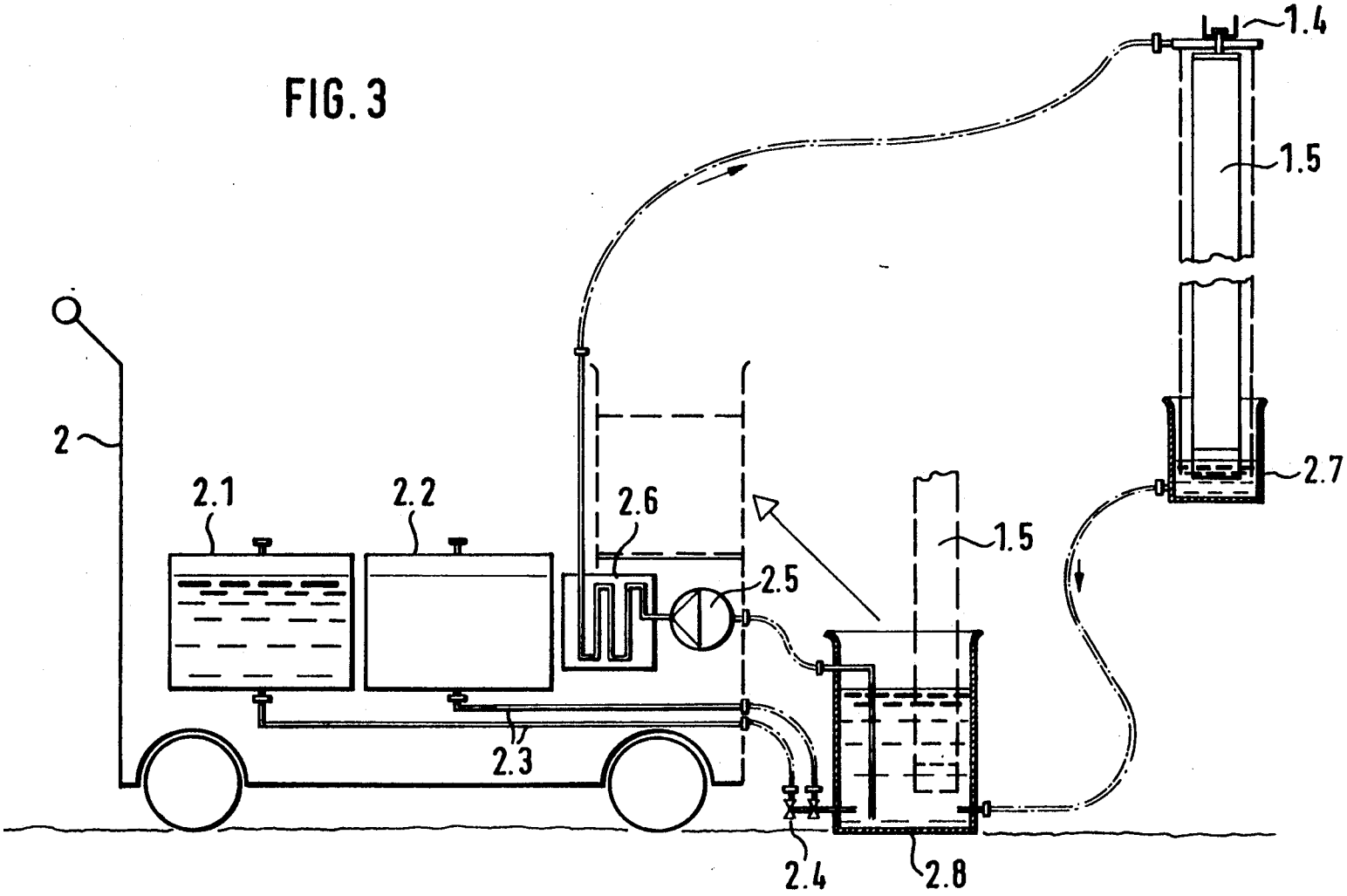
FIG. 3 is a diagrammatic overall view of the washing apparatus comprising the washing device to be suspended on the window furnishing runner rail, track or the like, and a carriage or truck carrying auxiliary units of the apparatus, in the position of use of the apparatus.

As shown in FIG. 3, the washing apparatus of the present invention also includes a collecting vessel in the form of a collecting trough 2.7 into which the lower end of the casing means 1.7 around the block configuration 1.5 extends.

Referring to FIG. 3 shown therein is a carriage or truck 2 which carries a storage and supply container 2.1 for washing-action medium and a further storage and supply container 2.2 for a rinsing liquid such as water. The containers 2.1 and 2.2 are connected by way of conduits 2.3 and valves 2.4 to an auxiliary vessel 2.8 which can be placed on the ground in the condition of use of the washing apparatus of the invention. The auxiliary vessel 2.8 can be selectively filled with washing-action medium from the container 2.1 or rinsing liquid from the container 2.2. Projecting into the auxiliary vessel 2.8 is a suction intake conduit which is in fluid communication with a pump 2.5 carried on the truck 2. The conduit 1.8 which goes to the nozzle assembly 1.2 is connected to the delivery side of the pump 2.5, to supply the washing-action medium or the rinsing liquid to the nozzle assembly 1.2. The liquid delivered by the pump 2.5 passes through a heating means indicated diagrammatically at 2.6 before being passed to the nozzle assembly 1.2.

Having described the structure of the apparatus according to the invention, the mode of operation thereof is as follows:

In normal use of the washing apparatus, the washing device 1 is firstly suspended on the runner rail or track member 1.4, in the above-indicated fashion, in the appropriate fixed position thereon. The nozzle assembly 1.2 then extends over the window furnishing portions such as slat members which have been pushed together to form the block configuration 1.5, and the window furnishing portions are enclosed by the casing means 1.7. The casing means 1.7 hangs down from the frame 1.6 and extends at its lower end into the connecting vessel 2.7 with a drain conduit which carries liquid from the window furnishing portions back into the auxiliary vessel 2.8.

After those preparatory operations, the auxiliary vessel 2.8 is filled with washing-action medium from the storage and supply container 2.1 and then that medium is conveyed by means of the pump 2.5 to the nozzle assembly 1.2 in order to run downwardly from above over the window furnishing portions making up the block configuration 1.5. The washing-action medium which drips off the bottom ends of the window furnishing portions in the casing means 1.7 and which is collected in the collecting trough 2.7 then flows back to the auxiliary vessel 2.8 and is then again passed in a circulatory fashion over the window furnishing portions, by means of the pump 2.5. When the cleaning operation is concluded after a specified washing time, then the washing-action medium is caused to flow from the auxiliary vessel 2.8 back into its associated container 2.1 and rinsing liquid is then passed into the auxiliary vessel 2.8 from the container 2.2. The rinsing liquid is then circulated over the block configuration 1.5 in the same fashion as described above.

Figure 4:
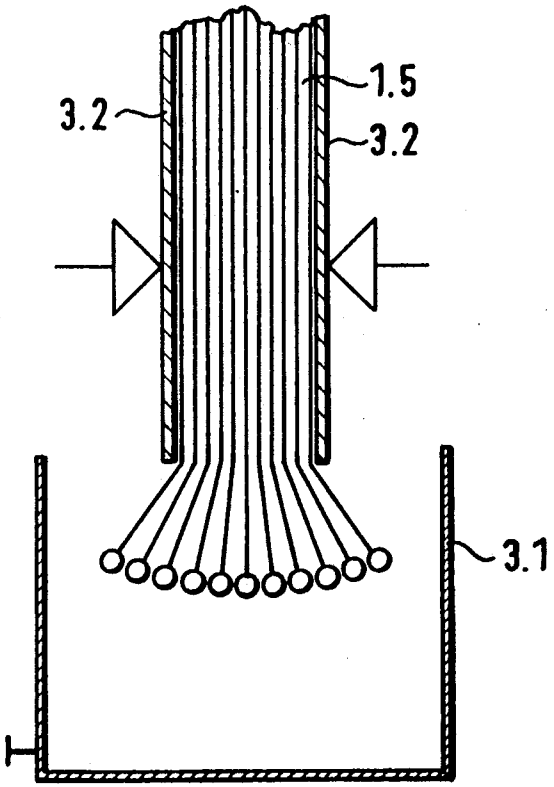
FIG. 4 is a view of the lower part of an array of window furnishing portions which are disposed between clamping bars, and a collecting trough which is arranged therebeneath.

After the rinsing operation the washing device 1 is removed. The block configuration 1.5 is then in a free-hanging condition and liquid thereon and therein drips off into a drip collecting trough 3.1 (as shown in FIG. 4) which is arranged beneath the block configuration 1. The trough 3.1 may be for example suitably suspended on connecting chains (not shown) interconnecting the window furnishing portions or slat member. When dealing with types of window furnishing portions such as slat members which are particularly sensitive in regard to retaining their shape, the block configuration can be disposed and dried between two lateral clamping bars which are indicated at 3.2 in FIG. 4, which keep them in their respective shape.

It will be seen therefore that the cleaning method which can be carried out by means of the above-described apparatus provides that the washing-action medium which is drawn from the auxiliary vessel 2.8 which stands on the ground, after the latter has been filled with the medium from the container 2.1, is circulated over the window furnishing to be cleaned, possibly being heated in the heating means 2.6 shown in FIG. 3. After the washing operation rinsing liquid is circulated from above in the same manner over the window furnishing material, followed by a drying step.

The method and apparatus in accordance with the invention provide that the cleaning operation can be carried out extremely quickly and all parts of the material to be cleaned are subjected to the cleaning effect under the same physical conditions. The setting times involved in setting up the apparatus are independent of the number and the area of the window furnishing portions to be cleaned and the fact that all window furnishing portions are treated in the same fashion means that there is a greatly reduced risk of variations in the lengths of the individual window furnishing portions.

Thus, in a further improvement of the present invention, the window furnishings are wetted or moisturized with clear water or other suitable wetting medium before the washing-action medium is circulated over the surfaces to be cleaned. This results in improved cleaning effects.

Accordingly, after the window furnishing are pushed together to from a vertically hanging block configuration, clear water is circulated from above and over the window furnishings for wetting the surfaces to be cleaned.

The apparatus used to carry out the procedure to circulate the clear water downward onto the window furnishings, can be the same, for example, as that used for the rinsing procedure in which the washing-action medium is rinsed away from the surfaces of the window furnishings to be cleaned. When clear water is used for the rinsing procedure, such clear water can also be used for the wetting medium.

It will be appreciated that the above-described method and apparatus in accordance with the principles of the present invention have been set forth solely by way of example and illustration thereof and that various modifications and alterations may be made therein without thereby departing from the spirit and scope of the invention.

I claim:

1. A method of cleaning window furnishings while located in their place of use, comprising: a first step of pushing together window furnishings to form a vertically hanging block configuration; a second step of circulating a wetting medium from above and over the window furnishings for wetting surfaces of said window furnishings to be cleaned; a third step of circulating a cleaning washing medium from above and over the window furnishings; a fourth step of circulating rinsing liquid from above and over the window furnishings; a fifth step of drying said window furnishings; and a sixth step of collecting surplus fluids at a base of said window furnishing, all said steps being carried out while said window furnishings are hanging vertically in their locations of normal use on windows, so that the window furnishings are not removed from the windows for cleaning; said wetting medium, washing medium and said rinsing liquid flowing downward from above due to gravity and covering said window furnishings uniformly while flowing downward with uniform velocity.

2. A method as defined in claim 1, wherein said window furnishings are dried in a free-hanging condition.

3. A method as defined in claim 1, including the step of holding said window furnishings between clamping members while being dried.

4. A method as defined in claim 1, wherein said wetting medium is clear water.

* * * * *